US005735544A

United States Patent [19]

Buckner

[11] Patent Number: 5,735,544

[45] Date of Patent: Apr. 7, 1998

[54] PAGE TURNING DEVICE

[76] Inventor: Jennifer L. Buckner, 8406 W. 98th St., Overland Park, Kans. 66212

[21] Appl. No.: 674,014

[22] Filed: Jul. 1, 1996

[51] Int. Cl.[6] ..... B42D 3/18

[52] U.S. Cl. ..... 281/45; 281/51

[58] Field of Search ..... D19/35, 36, 41–51, D19/53–58, 81–85, 99, 100; D21/204, 205; 15/3.53, 424; 401/6, 7, 88; 281/45, 51

[56] References Cited

U.S. PATENT DOCUMENTS

| | | | |
|---|---|---|---|
| D. 31,579 | 10/1899 | Todd, Jr. . | |
| D. 132,641 | 6/1942 | Sanders . | |
| D. 166,254 | 3/1952 | Gazda | D19/42 |
| D. 171,675 | 3/1954 | Wistosky . | |
| D. 188,970 | 10/1960 | Morris . | |
| D. 208,047 | 7/1967 | Brophy . | |
| D. 229,785 | 1/1974 | Lanoie . | |
| D. 279,297 | 6/1985 | Rosson . | |
| D. 303,810 | 10/1989 | Von Den Benken | D19/46 |
| D. 319,466 | 8/1991 | Summers | D19/49 |
| D. 337,611 | 7/1993 | Peersmann | D19/48 |
| D. 367,674 | 3/1996 | Kitzmiller | D19/35 |
| D. 383,781 | 9/1997 | Buckner | D19/54 |
| 413,599 | 10/1889 | Dean . | |
| 447,873 | 3/1891 | Hanimann . | |
| 494,510 | 3/1893 | Murphy . | |
| 886,096 | 4/1908 | Varder . | |
| 1,190,462 | 7/1916 | Rickard . | |
| 1,846,097 | 2/1932 | Fritz . | |
| 2,057,275 | 10/1936 | McKenna | D21/204 |
| 2,078,382 | 4/1937 | Hanshaw | D21/204 X |
| 2,099,613 | 11/1937 | Loewus . | |
| 2,148,684 | 2/1939 | Chesler . | |
| 2,330,954 | 10/1943 | Cotera . | |
| 2,419,746 | 4/1947 | Veria . | |
| 4,072,080 | 2/1978 | Conlin . | |
| 4,723,859 | 2/1988 | Kitoh . | |
| 5,028,053 | 7/1991 | Leopold | D21/204 X |
| 5,373,772 | 12/1994 | Shemoul . | |

FOREIGN PATENT DOCUMENTS

| | | |
|---|---|---|
| WO87/02942 | 5/1987 | WIPO . |

*Primary Examiner*—Frances Han
*Attorney, Agent, or Firm*—Shook, Hardy & Bacon L.L.P.

[57] ABSTRACT

A page turning device is provided that can be mounted on the end of a cylindrical writing instrument, such as a pencil. The page turning device has a substantially spherical body which has a plurality of deformable protuberances spaced about the outer surface of the body. The protuberances have an adhesive quality sufficient to grip a page of paper and are sized and spaced so that the body of the page turning device is prevented from contacting the page of paper to be turned. The page turning device has a hollow base connected to the outer surface of the body so that the page turning device can be mounted on the end of a cylindrical writing instrument.

10 Claims, 1 Drawing Sheet

PAGE TURNING DEVICE

BACKGROUND OF THE INVENTION

This invention relates to devices which can be used to turn pages of a document, and more particularly, to a device which can be mounted on the end of a writing instrument, such as a pencil.

Office workers often encounter situations wherein the pages of a document need to be turned or flipped. Frequently, the pages of a document must be scanned in the search for a specific piece of information, present on only a few pages of the document. A need therefore arises to effectively turn the pages of a document one at a time in as efficient a manner as possible.

Various devices and methods have been used to achieve this basic function. The devices and methods heretofore suggested have, however, had a number of distinct drawbacks.

One such previous device used to turn document pages is a rubber finger. In use, the rubber finger is placed over the finger of a user. The user then uses the rubber finger to grip and turn the pages. Use of this device is disadvantageous for a number of reasons. First, the rubber fingers must come in a variety of sizes to accommodate the various sizes of different user's fingers. This necessarily entails stocking a number of different sized rubber fingers. Second, the user's finger will often perspire within the rubber finger. Without proper cleaning, this perspiration will leave the rubber finger with an unpleasant odor. Finally, a user wearing a rubber finger often finds the rubber finger inconvenient when an office task other than page turning is encountered. Users may, for example, encounter the need to write while wearing a rubber finger. Use of a rubber finger renders these other tasks, such as writing, more difficult and less comfortable.

Additionally, users may simply wet their fingers when desiring to turn a page. The moistened finger tends to grip a page more effectively than does a dry finger. While this method can be an effective method of turning pages, it too has certain drawbacks. First, the moisture imparted to a user's finger can quickly evaporate, thus necessitating the need to rewet the finger. Such rewetting slows the process and hinders page turning efficiency. Second, personal hygiene is sacrificed. The user's hand is transferred from the mouth to document pages and back to the mouth. The documents encountered by the office worker are seldom flee from dirt and other foreign material such as ink. Thus, such a method exposes the user to less than hygienic conditions as the finger is transferred from the mouth to the page and then back again to the mouth. Third, such a method can damage the page being turned by exposing the page to moisture. This moisture can smear the ink or pencil marks on the page, thus rendering the document more difficult to read in the future.

Users may also use a standard pencil eraser to turn the pages of a document. Use of an eraser in this method has the advantage of added leverage and therefore less movement of the hand is necessary to turn a page, but such a method also has a number of drawbacks. As a non-spherical device, the eraser must be positioned at the proper angle by the user to effectively turn the pages of a document. When the eraser is not properly positioned, the page will not min. Further, use of an eraser to turn the pages of a document will often leave undesired eraser marks on the page.

SUMMARY OF THE INVENTION

Accordingly, it is a primary object of the present invention to provide a device which can be used to more easily turn the pages of a document without marring the pages of the document.

A further important object of this invention is to provide a page turning device which can be mounted on the end of a writing instrument, such as a pencil, so that the user of the page turning device can readily take notes and so that a minimal amount of movement is needed to effect a turn of the page.

It is yet another object of this invention to provide a device which can turn the pages of a document free from dependency on the angle at which the device strikes the page.

Another very important object of this invention is to provide a device for turning pages which freely allows the user to accomplish tasks other than turning pages concurrently with turning pages.

A still further object of this invention is to provide a device for turning document pages which does not need to be cleaned periodically in order to be free from unpleasant odors.

It is yet another object of this invention to provide a device for turning document pages which does not require the use of moisture, so that the document pages are not subjected to moisture and its possible damaging effects.

To accomplish the foregoing and other objects of the invention, a page turning device is provided that can be mounted on the end of a cylindrical writing instrument, such as a pencil. The page turning device has a substantially spherical body which has a plurality of deformable protuberances spaced about the outer surface of the body. The protuberances have an adhesive quality sufficient to grip a page of paper and are sized and spaced so that the body of the page turning device is prevented from contacting the page of paper to be turned. The page turning device has a hollow base connected to the outer surface of the body so that the page turning device can be mounted on the end of a cylindrical writing instrument.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENT

Figure 1:
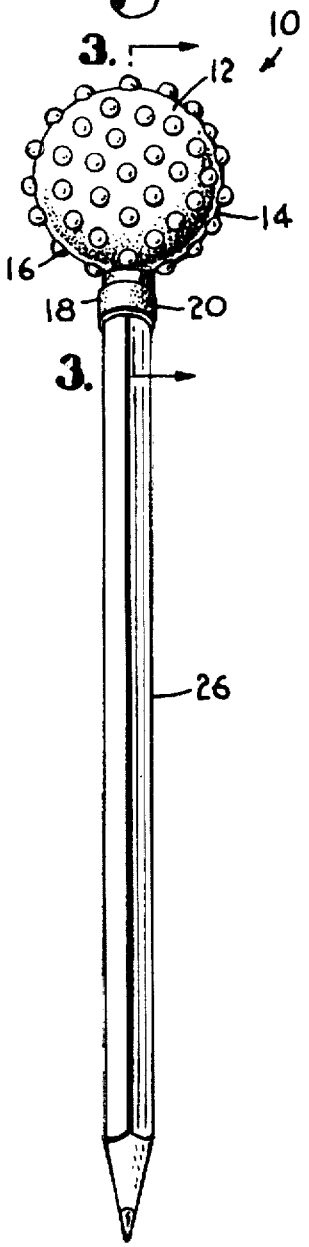
FIG. 1 is a front elevation view showing a page turning device of the present invention attached to the end of a standard pencil.
Figure 2:
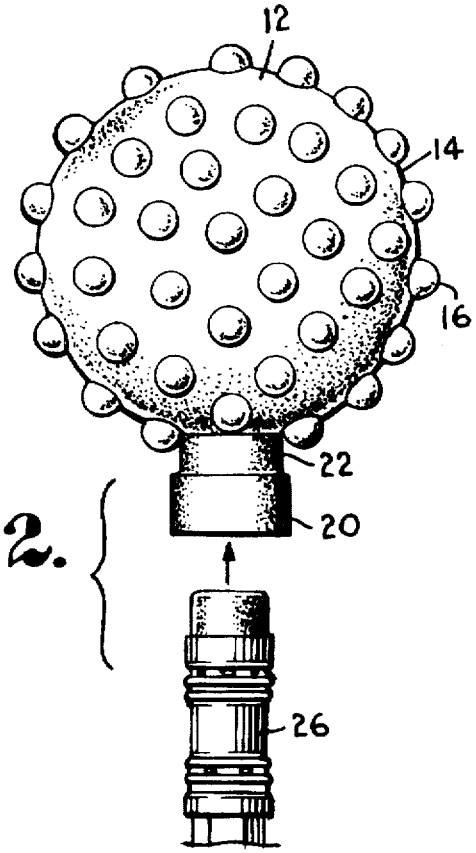
FIG. 2 is an exploded elevation view showing the manner in which the page turning device is attached to a standard pencil.

A page turning device embodying the principles of the present invention is broadly designated in the drawings by the reference numeral 10. Device 10 includes a body 12 which is substantially spherical in shape, and is preferably solid. Body 12 has an outer surface 14 on which a plurality of protuberances 16 are positioned. Protuberances 16 are preferably dome shaped hemispheres, although other shapes could be used and are within the scope of this invention.

Protuberances 16 are preferably formed concurrently with body 12 so that body 12 and protuberances 16 form a unified whole. In the preferred embodiment, protuberances 16 are spaced symmetrically about the outer surface 14 of body 12. Other spacing patterns are, however, within the scope of this invention. Protuberances 16 are slightly deformable, thus allowing more surface contact with the page to be turned. Further, protuberances 16 are sized and spaced such that more than one of the protuberances contacts the surface of a sheet or page or paper or other material when device 10 is in engagement with the page.

It should be understood that the device is well suited for turning sheets or pages that are separate, individual pages as well as pages that are joined together in some fashion, such as by binding, stapling or clipping. Further, the sheets or pages to be tamed will most commonly be made of paper, but it should be understood that the device is also well suited for taming pages made from other materials.

Figure 3:
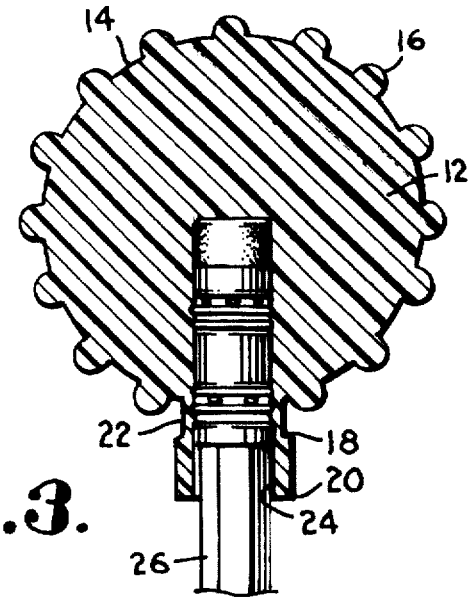
FIG. 3 is an elevation view of the page turning device taken in vertical section along line 3—3 of FIG. 1.

A base 18 is also formed adjacent the outer surface of body 12. Base 18 has a primary outer diameter 20, and a reduced outer diameter 22. Primary outer diameter 20 is located distal the outer surface 14 of body 12. Base 18 therefore has an increased wall thickness in the region of primary outer diameter 20, as can best be seen in FIG. 3. The increased wall thickness adds strength and support to base 18 in the region of base 18 that will first contact a writing instrument 26. The area of increased wall thickness therefore adds durability to device 10 by providing an area of increased wall thickness to resist cracking and other damage to the end region of base 18. Reduced outer diameter 22 is located adjacent outer surface 14 of body 12.

A centrally disposed cylindrical bore 24 extends longitudinally through the base and into body 12. The diameter of bore 24 is preferably slightly less than the outer diameter of a standard writing instrument 26. Because the inner diameter of bore 24 is slightly less than the diameter of writing instrument 26, when device 10 is placed on the end of the writing instrument, the instrument will force bore 24 to deform slightly outwardly, thus forming a friction fit between device 10 and writing instrument 26. Preferably, bore 24 extends to the center of body 12 to provide added stability when device 10 is being used to turn a page.

Page turning device 10 is preferably made of a material that is capable of being molded and which has a surface texture amenable to gripping a page of paper or other material. The material should have a surface texture that is slightly tacky or adhesive. When a material is used that is inherently tacky or adhesive, there is no need for any moisture to be used to properly turn a page of paper using device 10. Further, the material should be such that it does not mar or damage a page of paper when placed in contact with the page. Desirably, the material chosen should have a deformable yet elastic quality such that it allows protuberances 16 to deform slightly when placed under pressure to bring a greater surface area of protuberances 16 into contact with the page. Finally, the material selected should not leave a mark upon a page of paper after device 10 is placed in sliding contact with the page. Soft, moldable rubber materials would be suitable for device 10, for example latex rubber.

In operation, page turning device 10 is placed on the end of writing instrument 26, such as a pencil. Because the outer diameter of most writing instruments is generally similar, bore 24 can be sized so that device 10 can be placed on a variety of writing instruments. To place device 10 on the end of writing instrument 26, device 10 is grasped about body 12 and then writing instrument 26 is inserted into bore 24. Writing instrument 26, with device 10 attached, can thereafter continue to be used as a writing instrument. When the user desires to turn a page, instrument 26 is inverted so that body 12 is adjacent the page. Because body 12 is substantially spherical in shape, the user need not be concerned about the angle that writing instrument 26 forms relative to the page. Protuberances 16 are then placed in engagement with the page. Sufficient pressure is placed on writing instrument 26 and therefore upon protuberances 16 to slightly deform protuberances 16. The slight deformation of protuberances 16 ensures that a greater surface area of protuberances 16 contacts the page. The greater surface area, along with the pressure exerted on the protuberances, allows the page to be gripped more effectively. As stated above, protuberances 16 are sized and spaced so that more than one protuberance will contact the page at a time. This also allows device 10 to more effectively grip the page due to the number of protuberances 16 that are placed in contact with the page. The page can then be easily and effectively turned by a slight rotation or sliding of device 10. Protuberances 16 are maintained in contact with the page until the page has been turned. After a page has been tamed, writing instrument 26 is moved so that device 10 is no longer in contact with the page of paper. As stated above, device 10 will leave no mark on the page of paper that has been turned. Device 10 is then ready to flip subsequent pages of paper.

As can readily be seen, use of device 10 allows a user to quickly turn pages of a document one at a time without the disadvantages associated with prior art turning devices and methods.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention I claim:

1. A device mountable on the end of a cylindrical writing instrument, such as a pencil, for turning pages of a document, the device comprising:

a substantially spherical body having an outer surface;

a plurality of deformable protuberances spaced about said outer surface of said body wherein said protuberances have an adhesive quality sufficient to grip a page of paper;

wherein said protuberances are sized and spaced to prevent said body from contacting said page of paper;

wherein said protuberances are sized and spaced to allow a plurality of said protuberances to contact the page of paper; and means associated with said body for mounting said body on the end of the cylindrical writing instrument.

2. The device of claim 1 wherein said mounting means is an integral hollow base connected to said outer surface of said body, said base having a cylindrical inner surface defined by a cylindrical bore.

3. The device of claim 2 wherein the diameter of said cylindrical bore is sufficient to grip the end of the writing instrument.

4. The device of claim 2 wherein said cylindrical bore extends into said body.

5. The device of claim 4 wherein said bore extends into the center of said body.

6. The device of claim 1 wherein the protuberances are dome-shaped hemispheres.

7. The device of claim 1 wherein the device is made from a latex rubber material.

8. The device of claim 2 wherein said base is cylindrical and comprises a primary outside diameter section and a reduced outside diameter section.

9. A method of turning pages of a document utilizing a device, the device being mounted on the end of a writing instrument and comprising a substantially spherical body having an outer surface, a plurality of protuberances spaced about said outer surface of said body, and an integral hollow base connected to said outer surface of said body, said base having a cylindrical inner surface defined by a cylindrical bore, the method comprising:

inverting the writing instrument so that the device is near the page selected to be turned;

placing the device in contact with the page selected to be turned;

placing a small amount of force on said device so that the device is maintained in contacting relationship with the page selected to be turned; and moving the device in the selected direction to effectuate a turning of the selected page.

10. The method of claim 9 wherein only the protuberances of the device are placed in contact with the page selected to be turned.

* * * * *

UNITED STATES PATENT AND TRADEMARK OFFICE

CERTIFICATE OF CORRECTION

PATENT NO. : 5,735,544

DATED : April 7, 1998

INVENTOR(S) : Jennifer L. Buckner

It is certified that error appears in the above-indentified patent and that said Letters Patent is hereby corrected as shown below:

Column 1, line 59, the word "min" should read --turn--.

Column 3, line 11, the word "tamed" should read --turned--;
Column 3, line 13, the word "taming" should read --turning--.

Column 4, line 18, the word "tamed" should read --turned--.

Signed and Sealed this

Twenty-third Day of June, 1998

*Attest:*

*Attesting Officer*

BRUCE LEHMAN

*Commissioner of Patents and Trademarks*